United States Patent [19]

Kusz

[11] Patent Number: 5,020,681

[45] Date of Patent: Jun. 4, 1991

[54] CHILD RESISTANT CLOSURE

[75] Inventor: Maximillian Kusz, Waterville, Ohio

[73] Assignee: Owens-Illinois Closure Inc., Toledo, Ohio

[21] Appl. No.: 473,557

[22] Filed: Feb. 1, 1990

[51] Int. Cl.[5] ..... B65D 55/02

[52] U.S. Cl. ..... 215/220

[58] Field of Search ..... 215/201, 217, 219, 220, 215/222, 223

[56] References Cited

U.S. PATENT DOCUMENTS

| | | | |
|---|---|---|---|
| 3,097,756 | 7/1963 | Dorsey | 215/215 |
| 3,472,411 | 10/1969 | Turner | 215/220 |
| 3,795,338 | 3/1974 | Swartzbaugh et al. | 215/220 |
| 3,853,236 | 12/1974 | Ostrowsky | 215/220 |
| 3,857,505 | 12/1974 | Mumford et al. | 215/220 |
| 4,394,916 | 7/1983 | Smalley | 215/220 |
| 4,527,701 | 7/1985 | Schaubeck | 215/220 |

*Primary Examiner*—Gary E. Elkins

*Assistant Examiner*—Stephen K. Cronin

[57] ABSTRACT

A child resistant closure comprising outer and inner nested closure members each of which has a base wall on a peripheral skirt with sets of lugs on the inner surface of the outer closure member and on the outer surface of the inner closure member which are adapted to be engaged when the members are moved axially toward one another. The outer surface of the base wall of the inner closure member is provided with a plurality of ramps and depressions and the inner surface of the base wall of the outer closure member is formed with a plurality of integral spring fingers. When the closure is applied, the springs fingers engage the depressions and orient the outer closure member and inner closure member preventing inadvertent engagement of the lugs by any top load. When the outer closure member is rotated relative to the inner closure member without bringing the lugs thereof into engagement, the spring fingers slip over the ramps allowing the outer closure member to rotate with respect to the inner closure member.

5 Claims, 2 Drawing Sheets

CHILD RESISTANT CLOSURE

This invention relates to child resistant closures.

BACKGROUND AND SUMMARY OF THE INVENTION

Child resistant safety closures comprising two nested closure members are well known in the art. Typically, the outer and inner closure members are provided with cooperating sets of lugs which engage each other when the outer closure is rotated in the direction to remove the closure. A plurality of spring fingers on the inner surface of the base wall of the outer closure member yieldingly urge the outer closure member away from the inner closure member. In U.S. Pat. No. 3,857,505, the outer surface of the base wall of the inner closure member is formed with a plurality of ramps and associated tear drop shaped detent projections which are associated with the plurality of spring fingers on the inner surface of the base wall of the outer closure member such that when the outer closure member is rotated relative to the inner closure member in a direction to apply the closure, the spring fingers engage between the ramps and the detent projections to orient the outer closure member circumferentially relative to the inner closure member to prevent inadvertent engagement of the lugs by any top load. When the outer closure member is rotated in the opposite or unthreading direction, the spring fingers ride over or slip over the detent projections. When the closure is rotated in the unthreading direction and an axial force is applied to the outer closure member the lugs are interengaged to unthread the inner closure member from the container.

It has been found that the use of lugs and detent projections on the inner closure member together with the spring fingers limits the number of lugs on the closure members because of the limited vertical space between the closure members. As a result, it is necessary to rotate the outer closure member through a larger arc, sometimes as much as 90° to engage the lugs, necessitating grasping, releasing and regrasping the outer closure member.

Among the objectives of the present invention are to provide a child resistant closure which effectively holds the inner and outer closure members out of engagement thereby preventing top load from being applied during shipment of the containers to which the closures have been applied; which provides for a greater number of cooperating lugs; which has a lesser height; and which can be readily manufactured.

In accordance with the invention, a child resistant closure comprising outer and inner nested closure members each of which has a base wall on a peripheral skirt with sets of lugs on the inner surface of the outer closure member and on the outer surface of the inner closure member which are adapted to be engaged when the members are moved axially toward one another. The outer surface of the base wall of the inner closure member is provided with a plurality of ramps and depressions and the inner surface of the base wall of the outer closure member is formed with a plurality of integral spring fingers. When the closure is applied, the springs fingers engage the depressions and orient the outer closure member and inner closure member preventing inadvertent engagement of the lugs by any top load. When the outer closure member is rotated relative to the inner closure member without bring the lugs thereof into engagement, the spring fingers slip over the ramps allowing the outer closure member to rotate with respect to the inner closure member.

DESCRIPTION

Figure 1:
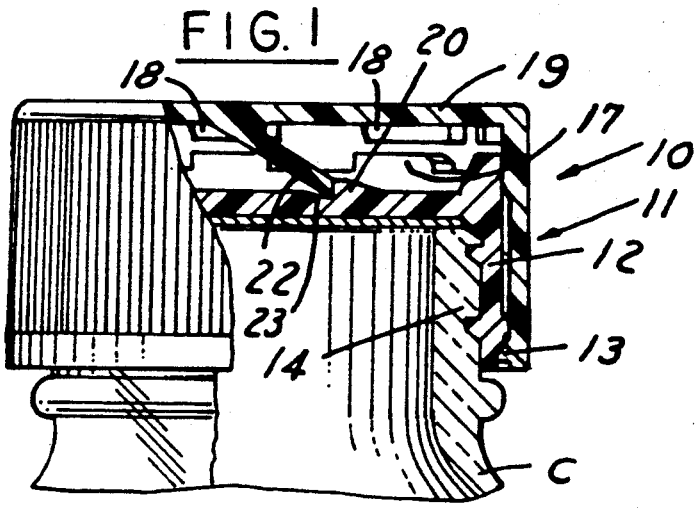
FIG. 1 is a fragmentary part sectional view of a package embodying the invention.
Figure 2:
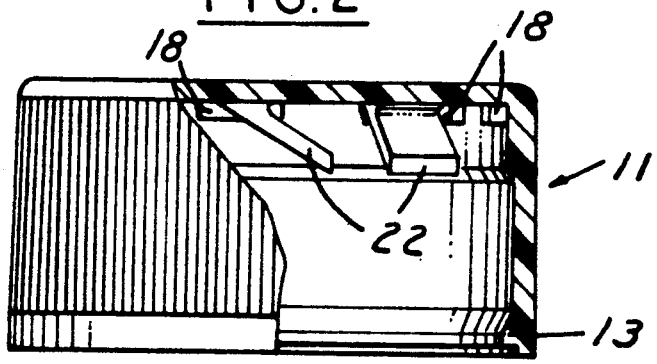
FIG. 2 is a part sectional elevational view of the outer closure member.
Figure 3:
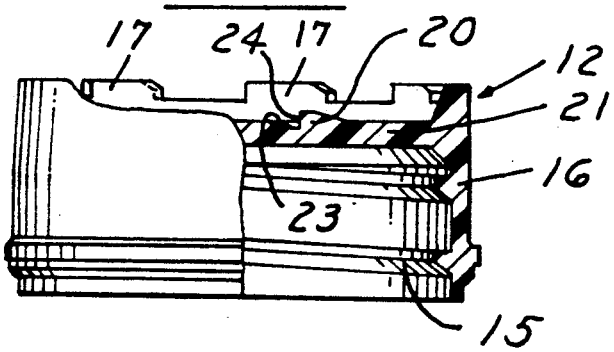
FIG. 3 is a part sectional elevational view of the inner closure member
Figure 5:
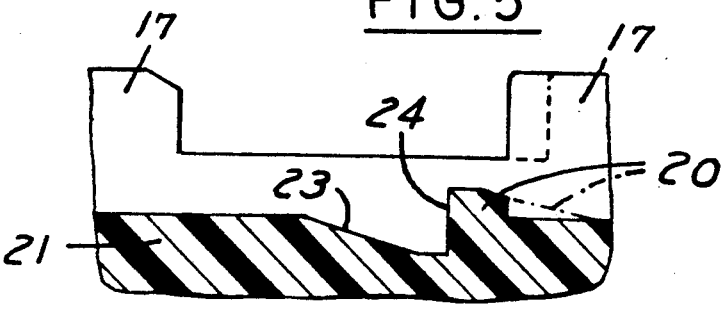
FIG. 5 is a fragmentary sectional view on a large scale taken along the lines 5—5 and FIG. 4.
Figure 4:
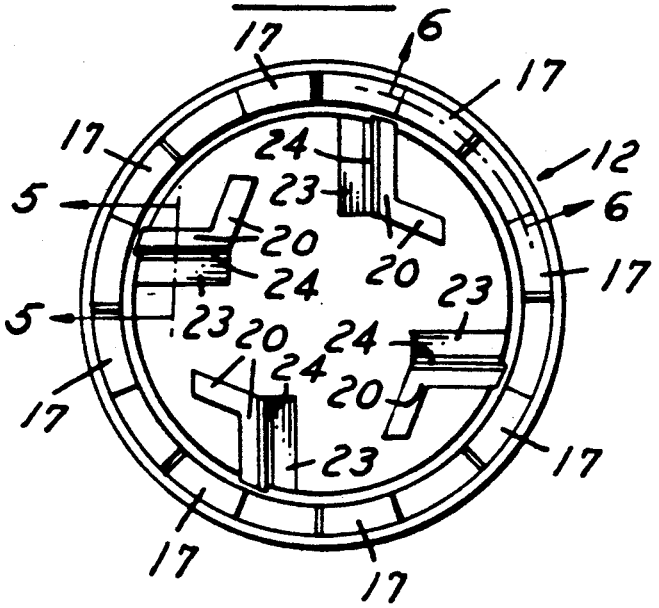
FIG. 4 is a plan view of the inner closure member.
Figure 6:
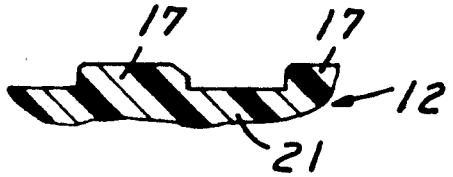
FIG. 6 is a fragmentary sectional view on a large scale taken along the lines 6—6 and FIG. 4.
Figure 7:
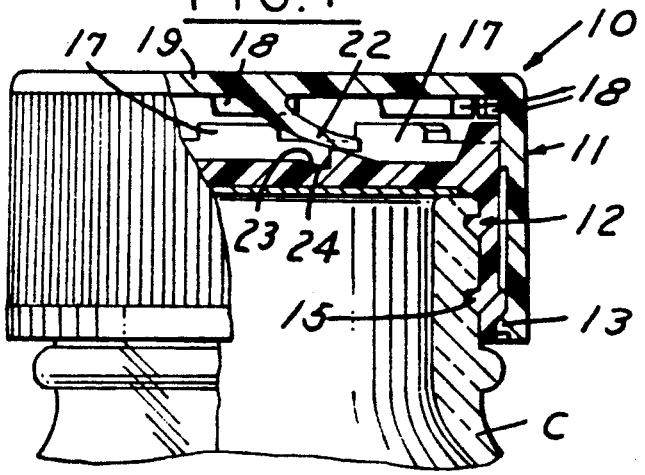
FIG. 7 is a view similar to FIG. 1 showing the closure members in a different operative position.

Referring to the drawings, the child resistant closure 10 comprises an outer closure member 11 and an inner closure member 12 which are telescoped in assembled relationship with the inner closure member extending into the outer closure member and retained therein by retaining bead 13. The closure is adapted to be applied to the neck of the container C which has threads 14 that are engaged by threads 15 on the inner surface of the peripheral wall 16 of the inner closure member. The inner closure member 12 is formed with a plurality or circumferentially spaced lugs 17 that are adapted to be engage by lugs 18 on the inner surface of the base wall 19 of the outer closure member. A plurality of ramps 20 are provided and circumferentially spaced relationship on the upper surface of the base wall 21 of the inner closure member 12 and are generally V-shaped. Integral spring fingers 22 extend in circumferentially spaced relation from the inner surface of the base wall 19 of the closure.

The aforementioned construction is like that previously described in U.S. Pat. No. 3,857,505, incorporated herein by reference, and functions such that when the closure is applied to a container, rotation of the outer closure member will cause the spring fingers 22 to engage the ramps 20 (FIG. 1) and rotation in the opposite or unthreading direction will cause the spring fingers 22 to slip over or ride over the ramps 20. When the outer closure member 11 is moved axially toward the inner closure member against the action of the spring fingers 22, the lugs 17, 18 become engaged so that the closure can be unthreaded from the container.

In accordance with the invention, a depression or recess 23 that is generally radial is associated with each ramp 20 adjacent its abutting surface 24 so that when the spring fingers 22 are in engagement with the ramps 20, the tips of the fingers 22 extend into the recesses 23 and hold the outer closure member 11 away from the inner closure member 12 and, at the same time orient the outer closure member 11 relative to the inner closure member 12 such that the lugs 18 on the outer closure member 11 are aligned with the lugs 17 on the inner closure member 12 and prevent any top load on the package from being applied to spring fingers 22. When the outer closure member 11 is rotated and at the same time forced axially toward the inner closure member 12, the lugs 18, 17 become engaged so that the closure can be removed from the container.

By providing depressions 23 instead of tear drop shaped projections of the type set forth in the aforementioned U.S. Pat. No. 3,857,505, the height of the ramps 20 is reduced and the reverse ratchet torque is reduced. In addition by omitting tear drop shaped projections, the number of lugs 18, 17 on the outer closure member 11 and inner closure member 12 may be increased, herein shown as eight in number, because there is sufficient room provided for the fingers 22 to be depressed without the vertical height restriction that is normally formed by the tear drops projecting upward.

The height of the ramps 20 is approximately equal to the thickness of the tip of the spring fingers 22. Because of the depression 23, the height of the ramps 20, with respect to the base wall 21, may be reduced without reducing the contact areas between the spring fingers 22 and the ramps 20.

It can thus be seen that there has been provided a child resistant closure which effectively holds in the inner and outer closure members out of engagement thereby preventing top load from being applied during shipment of the containers to which the closures have been applied; which provides for a greater number of cooperating lugs; which has a lesser height; and which can be readily manufactured.

I claim:

1. A child resistant closure comprising outer and inner nested closure members, each of which has a base wall on a peripheral skirt with sets of lugs on the inner surface of the outer closure member and on the outer surface of the inner closure member which are adapted to be engaged when the members are moved axially toward one another, the inner surface of the base wall of the outer closure member being formed with a plurality of integral spring fingers yieldingly urging said outer closure member away from said inner closure member, said outer surface of the base wall of the inner closure member being provided with a plurality of ramps and adjacent recesses, each said ramp including a ramp surface extending axially outwardly from the outer surface of the base wall of said inner closure and having an abutting surface extending axially inwardly below the outer surface of the inner closure and adapted to be engaged by the ends of the spring fingers, each said recess associated with an adjacent ramp includes an inclined surface extending axially inwardly from said outer surface of said inner closure member to said abutting surface of said ramp to form said recess, said ramps and recesses being constructed and arranged such that when the closure is rotated to apply the closure, the spring fingers engage the abutting surface and engage the recesses to orient the outer closure member and inner closure member such that the lugs on the outer closure member are aligned with the lugs on the inner closure member to prevent inadvertent engagement of the lugs by any top load, and when the outer closure member is rotated relative to the inner closure member without bringing the lugs thereof into engagement, the spring fingers slip over the ramps and the recesses allowing the outer closure member to rotate with respect to the inner closure member and when the outer closure member is rotated relative to the inner closure member and moved axially relative to the inner closure member, the lugs are brought into engagement so that the closure can be removed from the container.

2. The child resistant closure set forth in claim 1 wherein the height of said abutting surfaces is approximately equal to the thickness of the tip of the spring fingers.

3. The child resistant closure set forth in claim 2 wherein said recesses extend generally radially.

4. The child resistant closure set forth in an one of claims 1-3 wherein each said lug is located at less than 90° relative to an adjacent lug.

5. The child resistant closure set forth in any one of claims 1-3 wherein each said closure member has a greater number of lugs than ramps or spring fingers.

* * * * *